US006973682B2

(12) United States Patent
Zhadanov

(10) Patent No.: US 6,973,682 B2
(45) Date of Patent: Dec. 13, 2005

(54) DEVICE FOR SHOWERING AND THE LIKE

(76) Inventor: Eli Zhadanov, 2944 W. 5th St., Brooklyn, NY (US) 11214

( * ) Notice: Subject to any disclaimer, the term of this patent is extended or adjusted under 35 U.S.C. 154(b) by 0 days.

(21) Appl. No.: 10/418,579

(22) Filed: Apr. 19, 2003

(65) Prior Publication Data

US 2004/0205891 A1 Oct. 21, 2004

(51) Int. Cl.[7] ..... A47K 3/22
(52) U.S. Cl. ..... 4/601; 4/567; 4/615
(58) Field of Search ..... 4/567–570, 601, 4/615

(56) References Cited

U.S. PATENT DOCUMENTS

| | | | | | |
|---|---|---|---|---|---|
| 4,457,031 | A | * | 7/1984 | Moore | 4/614 |
| 4,541,131 | A | * | 9/1985 | Sussman | 4/596 |
| 4,964,181 | A | * | 10/1990 | Alpert | 4/597 |
| 5,428,850 | A | * | 7/1995 | Hiraishi et al. | 4/601 |
| 5,678,258 | A | * | 10/1997 | Healy | 4/601 |

* cited by examiner

*Primary Examiner*—Charles E. Phillips
(74) *Attorney, Agent, or Firm*—I. Zborovsky

(57) ABSTRACT

A device for showering and the like has a body and means providing in the body for issuing water for taking a shower, and a throughgoing receptacle formed in the body so that the body is formed as a peripherally closed element surrounding the receptacle, the receptacle being formed so as to allow a user access to an existing water control unit.

17 Claims, 2 Drawing Sheets

DEVICE FOR SHOWERING AND THE LIKE

BACKGROUND OF THE INVENTION

The present invention relates to a device for taking showers and the like.

Devices of the above mentioned general type are known in the art. There are a plurality of devices which are mountable in bathrooms and used for issuing water for taking showers and the like. It is believed that the existing devices can be further improved.

SUMMARY OF THE INVENTION

Accordingly, it is an object of the present invention to provide a device for showering and the like, which is a further improvement of the existing devices.

In keeping with these objects and with others which will become apparent hereinafter, one feature of the present invention resides, briefly stated, in a device for showering and the like, comprising a body and means providing in said body for issuing water for taking a shower; and a throughgoing receptacle formed in said body so that said body is formed as a peripherally closed element surrounding said receptacle, said receptacle being formed so as to allow a user access to existing water control means.

When the device is designed in accordance with the present invention, it is a further improvement of the existing devices.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 4:
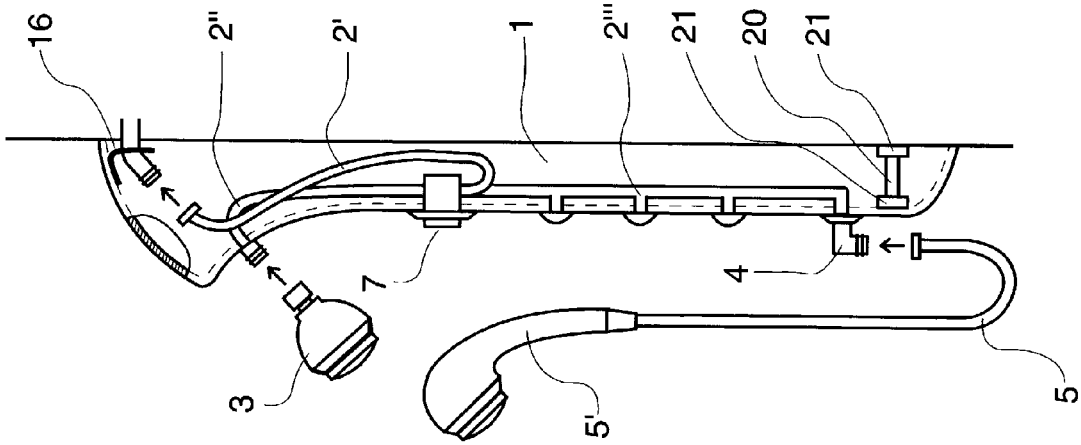
FIG. 4 is a side view of the inventive device mounted on a wall and showing a water supplying system.

A device for showering and the like, in accordance with the present invention has a single body which is identified as a whole with reference numeral 1. The body 1 is hollow and has a front wall, a peripheral wall and an open rear side with an edge to abut against a wall and the like as shown in the drawing. The body 1 is mountable for example on a wall of a bathroom, for example on a control element 7 by a clamp or the like as shown in FIG. 4.

A pipe or hose system includes a hose 2' extending from a water supplying pipe to the control 7, a hose 2" extending from the control 7 to a showerhead 3, and hoses 2'" extending from the control 7 to the nozzles 6 and to a shower hose 5 with an attached hand shower 5' or a tub outlet.

An outlet 4 is provided for connection to the shower hose 5 or a tub outlet. The body is further provided with water jet issuing elements can be formed as the jet nozzles 6 mounted in the body 1. As can be seen from the drawings, two groups of the jet nozzle 6 are provided. The jet nozzles in each group are spaced from one another in a longitudinal direction, or in other words in the direction of elongation of the body 1 and also the groups of the jet nozzles are spaced from one another in a transverse direction.

The control element 7 is provided in the body 1. It can be formed as a three-way zone control for switching water to corresponding elements, in particular to the showerhead 3, to the nozzles 6, or to the shower hose 5.

In accordance with the present invention a receptacle 8 is provided in the body 1 and formed as a throughgoing opening. The receptacle 8 is preferably elongated in the direction of elongation of the body 1. The body 1 is therefore formed as a peripherally closed element which surrounds the receptacle 8.

Figure 3:
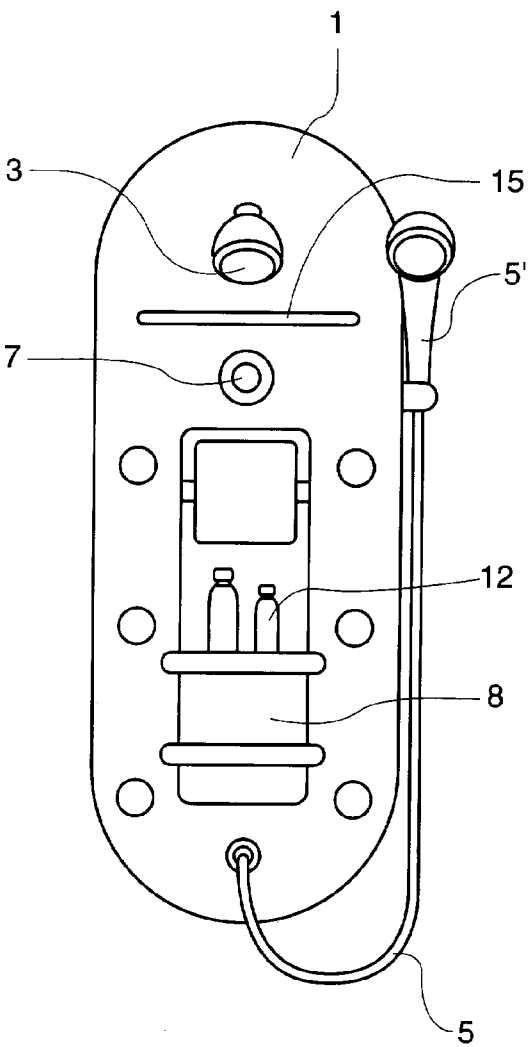
FIG. 3 is a view showing the inventive device with a further element attached to it and in the case when the existing water control element is located outside of the device.
Figure 2:
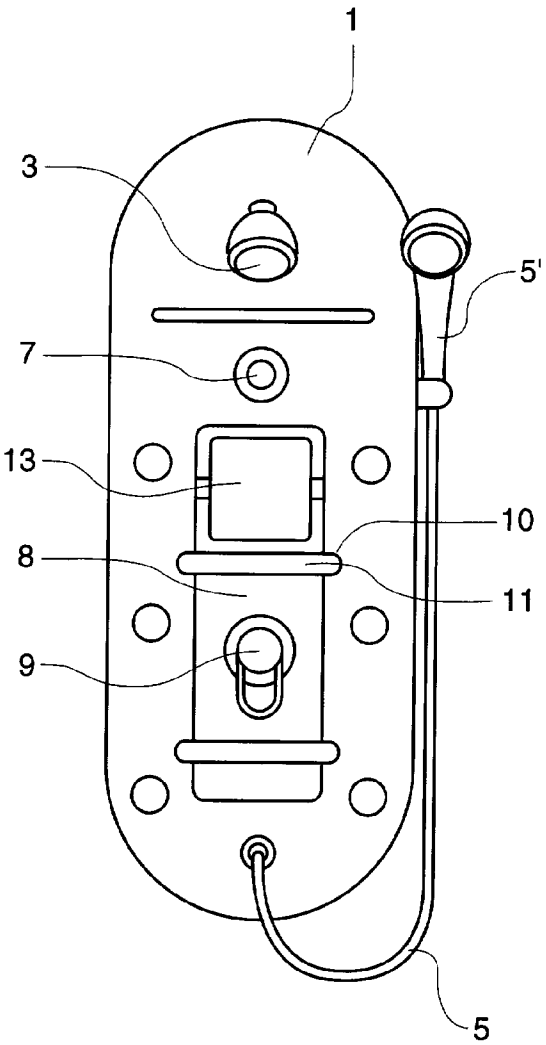
FIG. 2 is a view showing the inventive device with an existing water control element located in the area of the receptacle and some additional elements attached to it.
Figure 1:
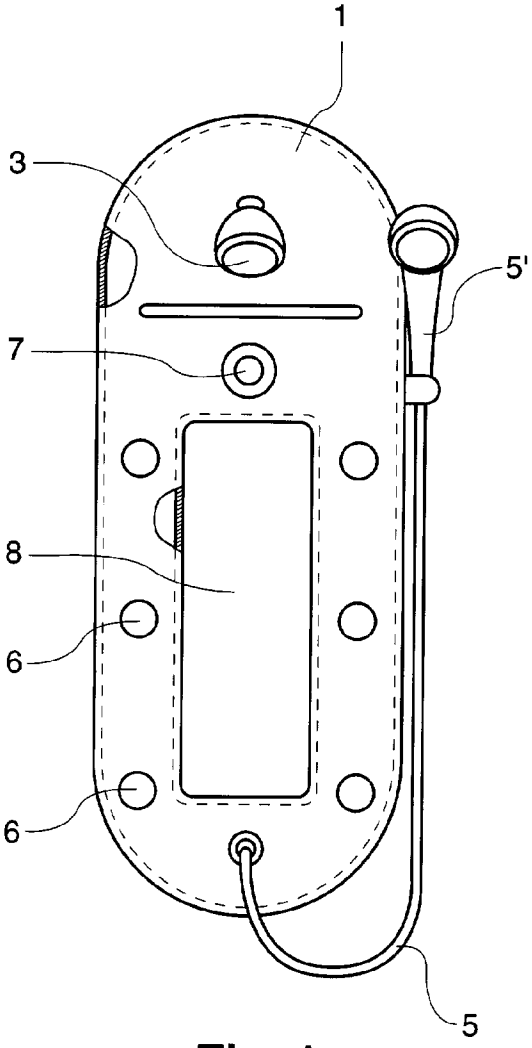
FIG. 1 is a view schematically showing a device for showering in accordance with the present invention.

As shown in FIGS. 1–3 the receptacle 8 is formed so that an existing water control element 9 mounted on the wall of a bathroom and the like can be accommodated in the receptacle 8 so that the body 1 does not interfere with the watex control element 9, so that a user can correspondingly operate the control element 9, as needed, to supply water, to change water temperature, etc.

In the region of the receptacle, means are also provided for attaching at least one supporting member for supporting accessories. These means can be formed for example as a groove 10 in which a shelf 11 can be introduced forcedly to be retained in it. Accessories such as for example bottles with shampoo, conditioner, soap, etc. 12 can be placed on the shelf 11. As shown in FIG. 2, for example two shelves 11 can be provided at both sides of the control element 9 as considered in a vertical direction. When it is not necessary to arrange the control element 9 in the region of the receptacle, the shelves 11 can occupy more space, and can be provided at various locations in the direction of elongation of the receptacle. As shown in the drawings, the direction of elongation of the receptacle 8 coincides with the direction of elongation of the body 1.

Additionally, a mirror 13 can be also mounted in an end region of the receptacle 8 on supporting means, formed for example connecting strips inserted in the grooves of the body.

A bracket 15 can be also mounted on the receptacle 1 in its upper region as shown in the drawings, for example for supporting a small towel and the like.

Figure 5:
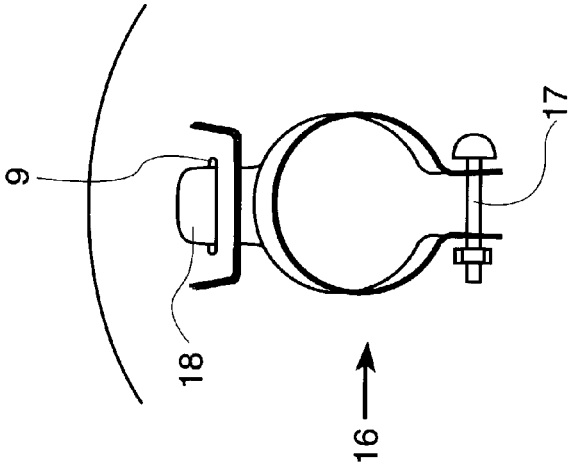
FIG. 5 is a view showing a clamp for mounting the device on a water supplying pipe.

The body 1 can be attached to a shower arm by a clamp 16 shown in FIG. 5. The clamp can be tightened by a set screw 17 and provided with a lip 18 which is inserted into a slot 19 of the body 1 or of a part attached to the body 1, as additional mounting means which prevent movement of the body.

The body 1 can be additionally attached to a wall or the like at another location, for example by a displacement preventing bracket 20 which has two flanges 21 attachable to the body 1 and to the wall for example by an adhesive, a screw, and the like.

Figure 6:
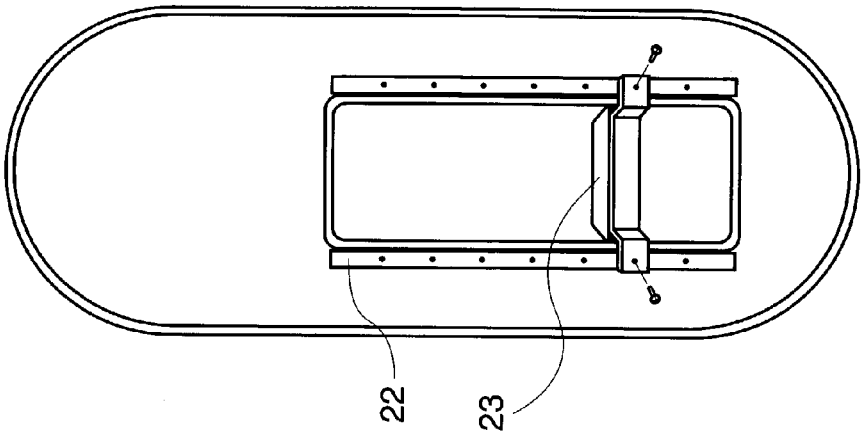
FIG. 6 is a view showing mounting of the shelves, mirrors, etc.

FIG. 6 shows another way of mounting of the shelf 11 or the mirror 13. Vertical guides 22 provided with holes are arranged on the rear side of the body 1, while the shelf or the mirror has a flange 23 with two holes, so that screws can pass through aligned holes of the flange and the guides to mount the shelf or the mirror at a desired height.

It will be understood that each of the elements described above, or two or more together, may also find a useful application in other types of constructions differing from the types described above.

While the invention has been illustrated and described as embodied in a device for showering and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A device for showering and the like, comprising a body having a front wall, a peripheral wall and an open rear side with an edge configured to abut against a wall; hose means associated with said body for supplying water for taking a shower; and a throughgoing receptacle formed in said body so that said body is formed as an element surrounding said receptacle, said receptacle being formed as a single receptacle configured so that it allows a user through said receptacle access to existing water control means in assembled condition at least one supporting member and means for attaching said, at least one supporting member to said device, such that said at least one supporting member will reside in said receptacle to allow arrangement in said receptacle of at least one accessory; means for connecting said hose means to a source of water; and separate means for suspending said body on a part of the source of water; and a plurality of water outlets located at both sides of said receptacle.

2. A device as defined in claim 1, wherein said front wall of said body is elongated in a predetermined direction, said receptacle being elongated in a direction which corresponds to the predetermined direction of elongation of said body.

3. A device as defined in claim 1, wherein said hose means include first hose means connectable to a source of water; and further comprising second hose means connectable to a hand shower; and third hose means connectable to a plurality of outlets formed in said body to issue water jets; and a control element connected with said first hose means, second hose means and third hose means and controlling a water distribution between said first, second and third hose means.

4. A device as defined in claim 1, further comprising, said means for attaching provides for attachment at different heights.

5. A device as defined in claim 4, wherein said means for attaching includes a plurality of grooves provided in said front wall of said body at both sides of said receptacle and receiving said supporting member.

6. A device as defined in claim 1, wherein said outlets are formed to issue water jets.

7. A device as defined in claim 6, wherein said front wall of said body is elongated in a predetermined direction, said receptacle being also elongated in said predetermined direction, said outlets including at least two groups of outlets arranged so that the outlets in said groups are spaced from one another in said direction of elongation, while said groups are located at opposite sides of said receptacle and spaced from one another in a direction transverse to said direction of elongation.

8. A device as defined in claim 1, wherein said front wall of said body has an additional outlet for connection to a hand shower element or to a tub outlet; and means for switching water supply to the hand shower element or the tub outlet.

9. A device as defined in claim 1; and further comprising means for supporting a mirror on said front wall in said receptacle.

10. A device as defined in claim 9; and further comprising a mirror which is supported by said mirror supporting means in said receptacle on said front wall.

11. A device as defined in claim 1; and further comprising a control element mounted on said body and controlling water distribution.

12. A device as defined in claim 1, wherein said body has a connection for connecting to a showerhead; and means for switching water to the showerhead.

13. A device as defined in claim 1, wherein said front wall of said body has said water outlets formed for issuance of water jets, an outlet connectable with a handshower or a tub outlet, a showerhead outlet, and control means for switching water from one to another of said outlets.

14. A device for showering and the like, comprising a body having a front wall, a peripheral wall and an open rear side with an edge configured to abut against a wall; hose means associated with said body for supplying water for taking a shower; and a throughgoing receptacle formed in said body so that said body is formed as an element surrounding said receptacle, said receptacle being formed so as to allow a user access to existing water control means; means for connecting said hose means to a source of water; separate means for suspending said body on a part of the source of water; and means for mounting said body, wherein said mounting means includes a clamp mountable on a part of the source of water, said hollow body having a slot by which it is suspended on said clamp.

15. A device as defined in claim 14, and further comprising additional mounting means spaced from said first-mentioned mounting means and operative for additionally mounting said body to a surface to prevent moving of said body.

16. A device as defined in claim 1, said separate means for suspending said body on a part of the source of water being formed to suspend said body on a showerhead pipe.

17. A device as defined in claim 16, wherein said body is formed as a single hollow body which covers said hose means, said connecting means, and said suspending means.

* * * * *